United States Patent [19]

Thier et al.

[11] Patent Number: 4,893,386

[45] Date of Patent: Jan. 16, 1990

[54] APPARATUS FOR THE PRODUCTION OF PATTERN WARPS ETC. ON A CONE WARPING MACHINE

[75] Inventors: Wilhelm Thier, Billerbeck; Josef Lenzen, Duelman; Erich Uckelmann, deceased, late of Ahaus-Wessum, by Renate Uckelmann, heiress; Herbert Wisniewski, Coesfeld-Lette, all of Fed. Rep. of Germany

[73] Assignee: Hergeth Hollingsworth GmbH, Duelman, Fed. Rep. of Germany

[21] Appl. No.: 252,295

[22] Filed: Sep. 30, 1988

[30] Foreign Application Priority Data

Oct. 6, 1987 [DE] Fed. Rep. of Germany ..... 3733692

[51] Int. Cl.[4] ..... D02H 3/00; D02H 5/00; D02H 7/00

[52] U.S. Cl. ..... 28/191; 28/184; 28/198

[58] Field of Search ..... 28/184, 190, 191, 195, 28/198, 199

[56] References Cited

U.S. PATENT DOCUMENTS 3,879,824 4/1975 Mizuno ..... 28/211
4,831,695 5/1989 Baltzer ..... 28/191

FOREIGN PATENT DOCUMENTS 1050931 9/1983 France ..... 28/191

*Primary Examiner*—Werner H. Schroeder
*Assistant Examiner*—Jodi A. Tokar
*Attorney, Agent, or Firm*—Cort Flint

[57] ABSTRACT

An apparatus for producing pattern warps on a cone warping machine comprises a drum, a support, a warping reed and lease rods, means for displacing the lease rods, and a driving means for rotating the drum. There is provided a tong-type gripper (60) for shifting the lease rods (61) axially and in height. The warping reed (25) is displaceably supported as a sliding reed from one central position to both sides, and it may be adjusted vertically with respect to drum (2).

21 Claims, 10 Drawing Sheets

APPARATUS FOR THE PRODUCTION OF PATTERN WARPS ETC. ON A CONE WARPING MACHINE

BACKGROUND OF THE INVENTION

The invention relates to an apparatus for the production of pattern warps, short warps, etc. on a cone warping machine. The apparatus comprises a drum having a cone portion, a support to receive a heddle frame, and a warping reed. Lease rods ar disposed in slots of the cone portion of the drum and a device is provided for displacing the lease rods along the drum axis. Drive means is provided for rotating the drum and for moving the support along the drum axis as well. A control means controls the drive means for rotating the drum and for displacing the support in a predetermined relationship.

There have been known various embodiments of cone warping machines of the type wherein leases and thread divisions may be obtained with the yarn sheet disposed on the drum or its cone portion by using lease rods. A support is used which is movable along the drum and carries a heddle frame and a warping reed. The support is a yoke enclosing the drum. The yoke-type support is provided with entrainment means adjustable for advancing the lease rods in radial direction to the drum. Such a cone warping machine entails a relatively expensive design. In operation, it is rather clumsy because the support must be moved towards the drum axis for displacing the lease rod.

It is the object of the invention to provide a cone warping machine of the type mentioned at the outset which is of a simple design and more effective while complying with all of the required duties.

SUMMARY OF THE INVENTION

The invention is characterized in that the device for displacing the lease rods is a tong-type gripper means. The tong-type gripper means is used for displacing the lease rods towards the drum axis, regardless of whether leases or thread divisions are realized. The cone warping machine is provided with an assembly of a reduced expenditure and of a low weight. Because of the low mass, a quick mobility of the unit is provided. The respective function may be performed rapidly. The controllability of and access to the cone warping machine are substantially improved and the performance is substantially safer.

According to another feature of the invention, the warping reed is adjustable vertically relative to the longitudinal axis of the drum, and is adjustable from a central position to both sides with respect to the support. The possible movements of the warping reed contribute to a quick functional performance concerning the change of positions of the yarn sheets. At the same time, an increased output with regard to the production of pattern warps, etc. may be realized with the cone warping machine.

In addition, it is important for the invention that the heddle frame together with the heddles is adjustable in height as well as transversely to the drum. If said heddle frame is moved more closely to the drum, a larger shed opening is obtained, thus facilitating handling for the displacement of the lease rod. During warping of the yarn sheets on the drum or cone portion, the heddle frame is set back transversely to the drum. The spread angle for the yarn sheets from the heddle frame to the warping reed is reduced accordingly with a resultant reduced friction of the threads at the warping reed. Therefore, the yarn sheets may be wound more quickly onto the drum.

In total, the resultant cone warping machine is of a simpler design, its functions more versatile, may be achieved in a quicker sequence, and its operation at a relatively high speed is reliable and troublefree.

The gripper is in the form of gripper tongs having tong legs provided in a horizontal plane. One leg is preferably stationary, while the other is hook-shaped and disposed movably in the horizontal plane. The actuation of the movable tong leg may be performed by a piston-cylinder-unit etc. In its closing movement, the hook-shaped tong-leg engages under the angular portion of the lease rod. The gripper in itself is a relatively small constructional element displaceable in total along the drum and adapted to move in one direction or the other. The adjusting means for the gripper is adjustable in height at the support permitting the lease rods at the lower part of the thread packages and those at the upper part thereof to be operated with one and the same gripper.

Preferably, the warping reed is supported by a cross slide connected to the support. The warping reed may be moved easily along the drum axis and transversely thereto without adjusting or moving the support.

According to another feature of the invention, the support includes a motor to drive the movements of the sliding reed in transverse direction to the drum, for the height adjustment of the support and the displacement of the tong carriage in transverse direction to the drum. Independent drives are advantageously provided for the adjustment of the sliding reed for the adjustment of the tongs carriage lengthwise relative to the drum. The independent drives are preferably mounted on the carriage adjustable in height. Suitably, the heddle frame is adjustable per se. It may be adjusted along a guidance extending transversely to the drum axis, the adjustment being performed preferably by an air cylinder.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
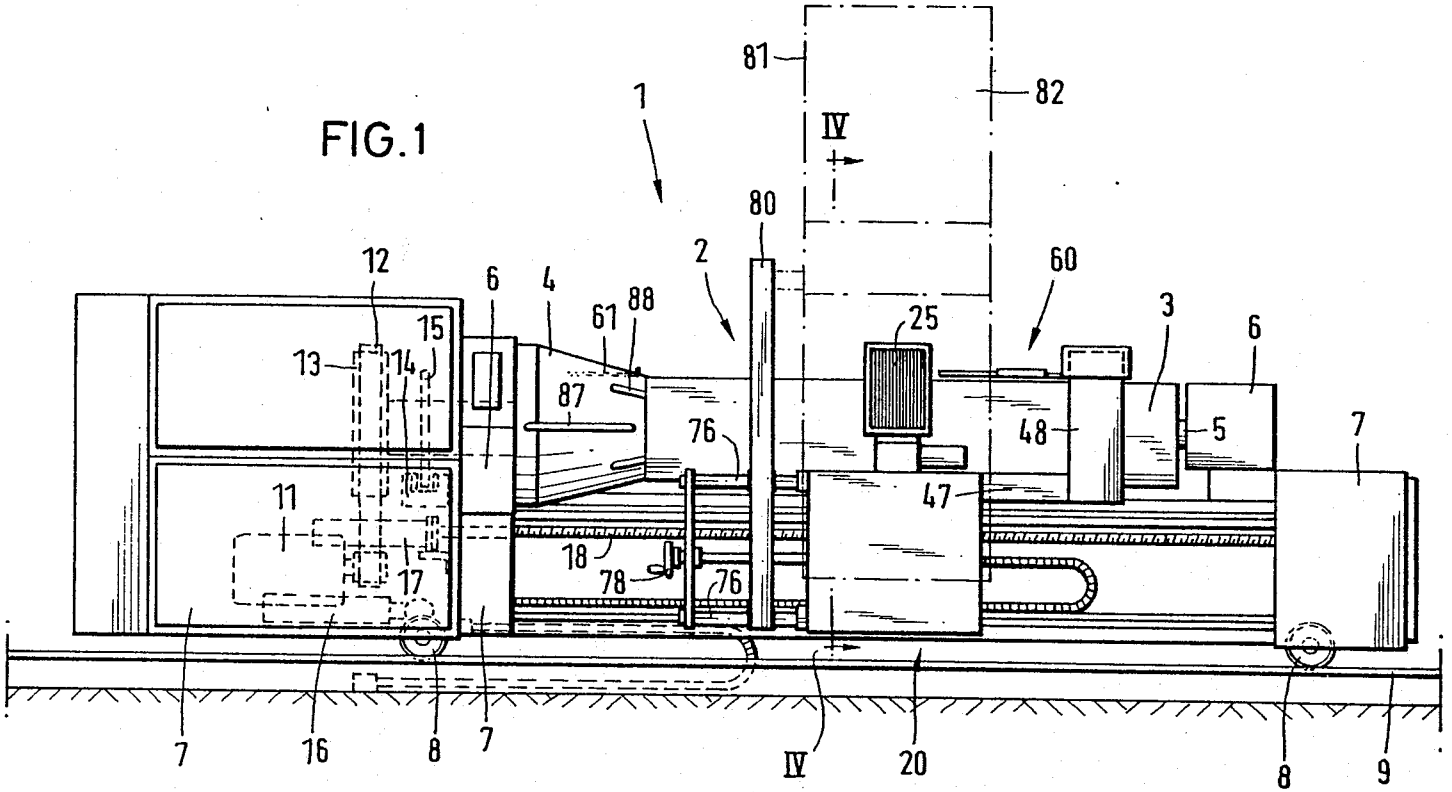
FIG. 1 is a schematic, elevational view of one embodiment of a cone warping machine according to the invention.
Figure 2:
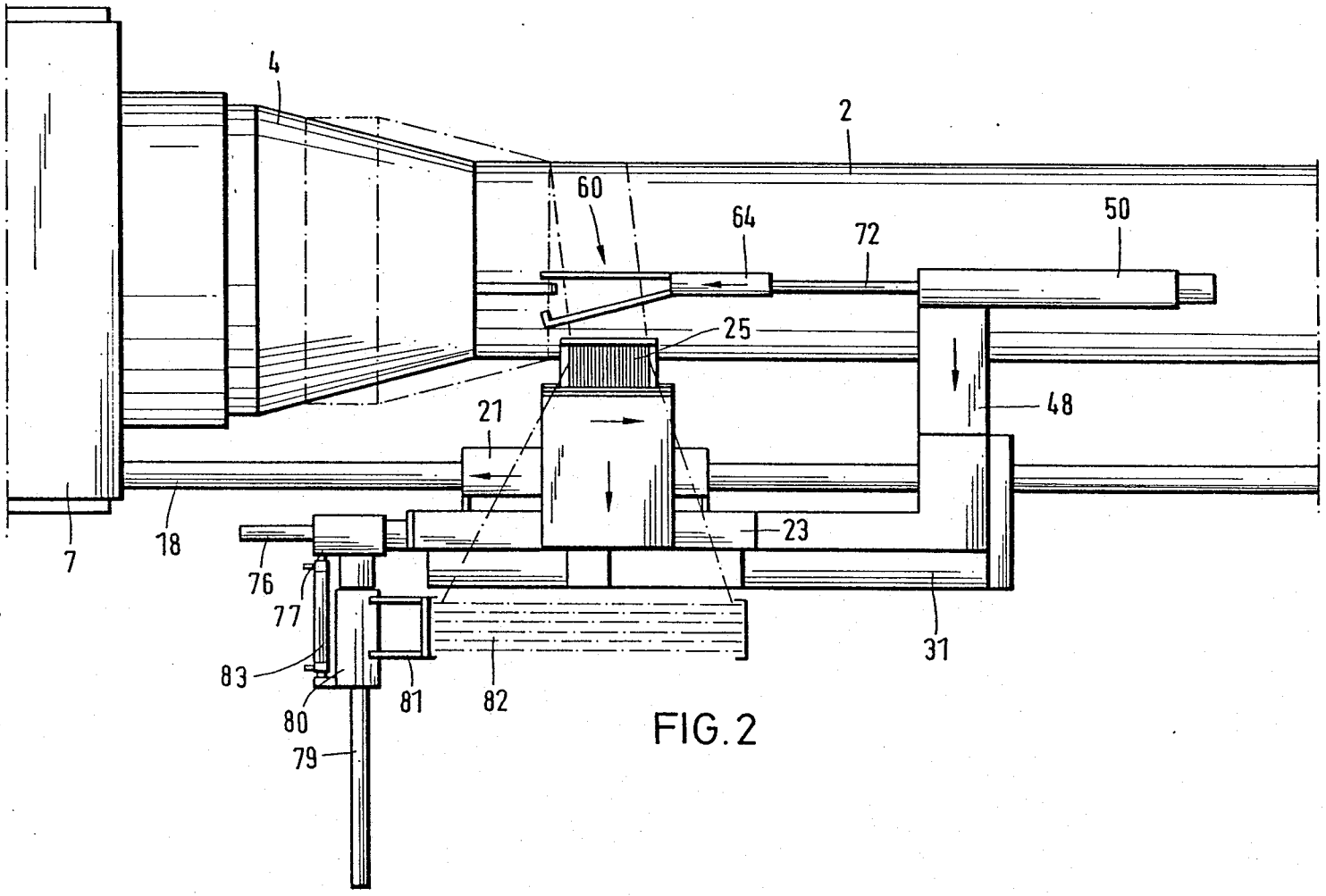
FIG. 2 is a plan view of the cone warping machine of FIG. 1.

Referring now in more detail to the drawings, a cone warping machine 1 for the production of pattern warps, short warps, etc. is illustrated which comprises a drum 2 consisting of a cylindrical portion 3 and a cone portion 4. It is supported by a basic frame 7 by means of bearings 6. Basic frame 7 is a carriage adapted to reciprocate on rails 9 by means of running wheels 8.

A motor 11 with angular momentum generator drives a belt pulley 13 via a transmission member 12 and a shaft 5 and drum 2 accordingly. A brake 14 is provided for a brake disk 15. A traction motor 16 moves carriage frame 7. Another motor 17 is responsible for the drive of a thread guiding spindle 18 by which a support 20 may be reciprocated along the drum 2 by means of a threaded nut 19.

Figure 3:
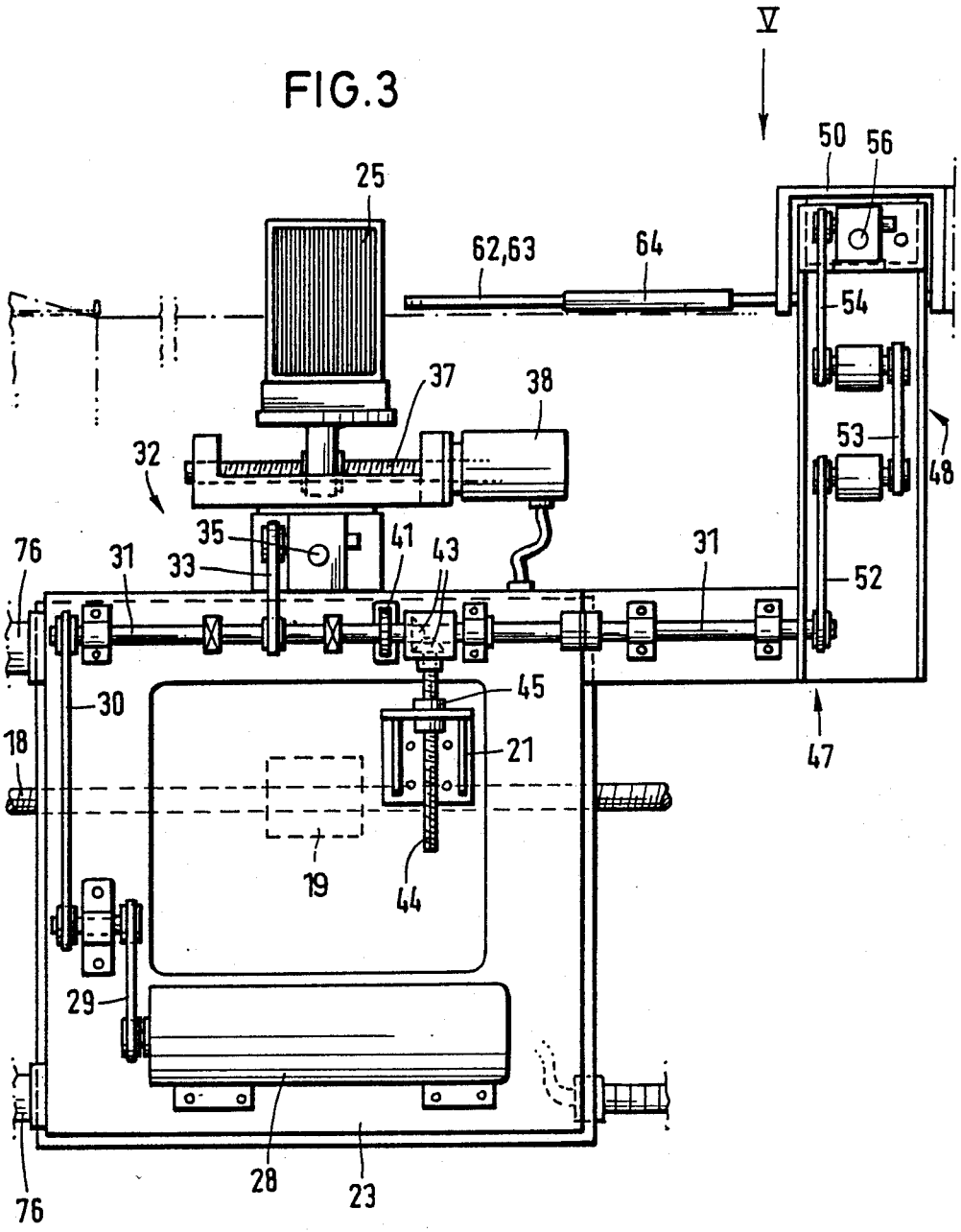
FIG. 3 is a view of the support with driving systems fixed thereto for the height adjustment, the transverse adjustment of the sliding reed and the adjustment of the tongs carriage.
Figure 4:
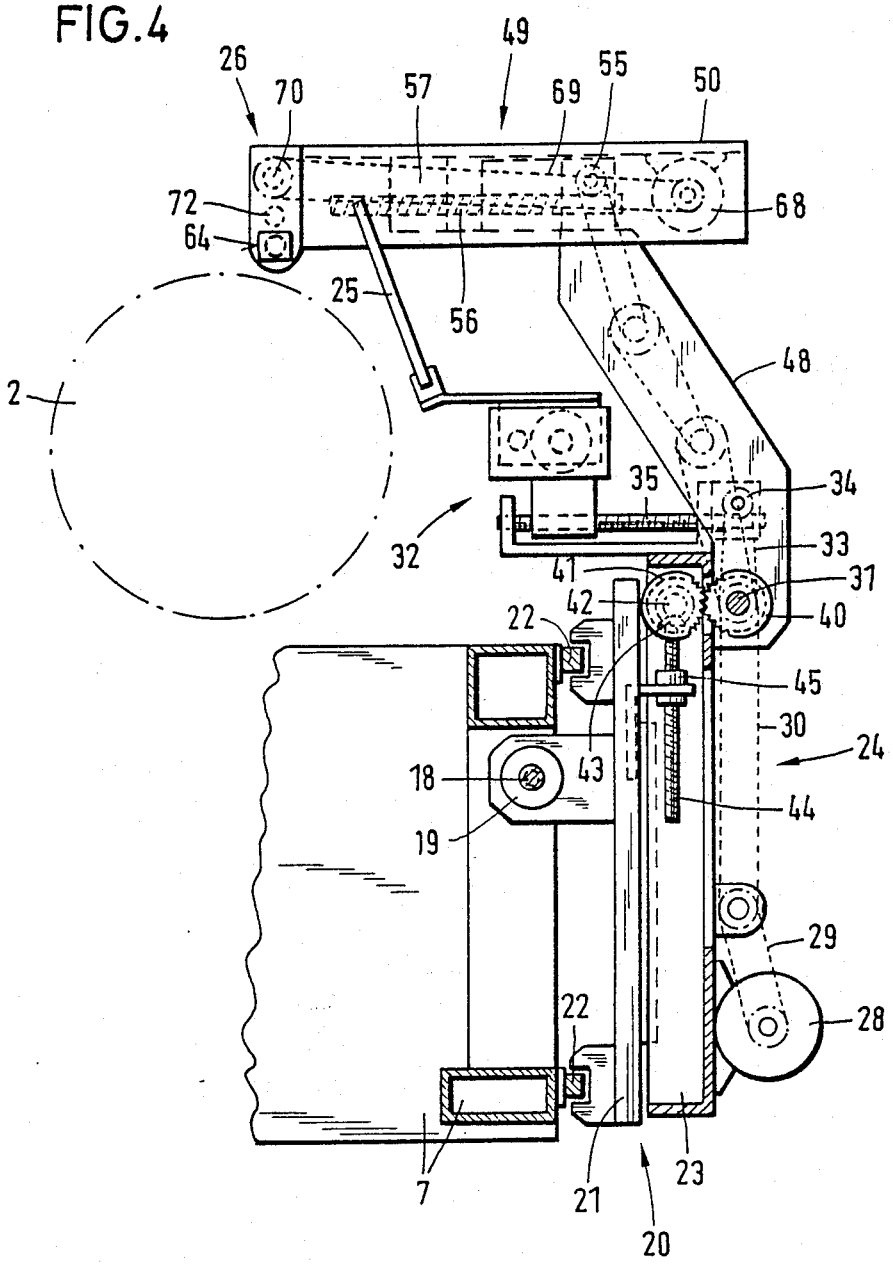
FIG. 4 is a cross section along line IV—IV of FIG. 1.

As can best be seen in FIG. 4, support 20 includes a carriage 21 adapted to reciprocate on guides 22 along the drum by means of spindle 18. At carriage 21, another carriage 23 is mounted so as to be adjustable in height and to carry the driving system 34 for the movement of the sliding reed 25 transversely to the drum. The height adjustment of carriage 23 also adjusts the other elements secured thereto and the displacement of the tong mechanism transversely to the drum. A motor 28 drives shaft 31 from which a plurality of drives are derived by means of transmission members 29, 30. Sliding reed 25 is disposed on a cross slide 32. A transmission member 33 extends from shaft 31 to a worm drive 34 for driving a threaded spindle 35. Carriage 32 is displaced transversely to the longitudinal axis of drum 2 by thread spindle 35. Sliding reed 25 is seated on a spindle 37 driven by an independent motor 38 fixed to carriage 32. The displacement of reed 25 lengthwise of drum 2 is independent of the displacement transversely to the drum axis. There is a gear wheel 40 on shaft 31 meshing with another gear wheel 41 whose shaft 42 is connected to a worm drive 43 driving spindle 44. Spindle nut 45 is fixed to the support carriage 21 so that carriage 23 is displaced in height upon actuation of spindle 44. As can best be seen in FIG. 3, one side of carriage 23 is provided with a cantilever 47 which accommodates the drive derived from shaft 31 for the automatic movements of tong 49. A housing 50 is displaceably carried on a housing 48 arranged transversely to drum 2. The corresponding drive is derived via belt drives 52, 53, 54 from shaft 31 (FIG. 3). Belt drive 54 drives the worm gear 55 which operates the thread spindle 56 whose spindle nut 57 is integrally connected to housing 50.

Figure 5:
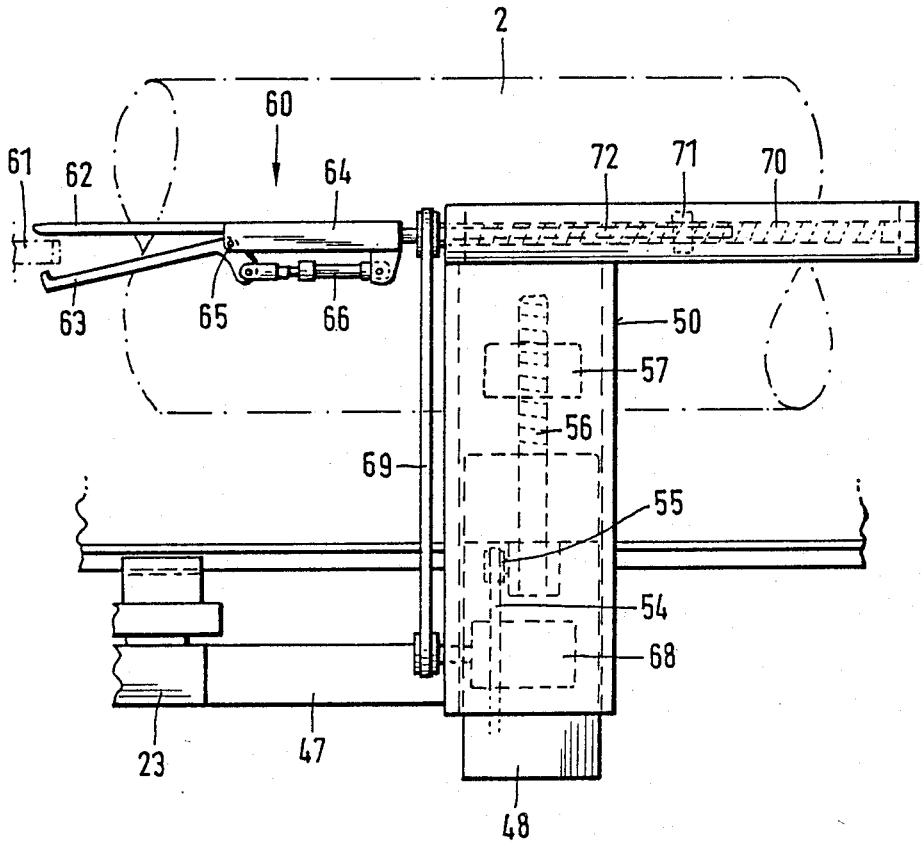
FIG. 5 is a plan view according to arrow V of FIG. 3 scaled up.

As can best be seen in FIG. 5, gripper means 60 for lease rods 61 is provided in the cone portion 4 of drum 2 and contains tong legs 62 and 63 (FIG. 5). Leg 62 is mounted stationarily on housing 64 and leg 63 is swivelled as an angular member about axle 65. The swivel movement is caused by means of piston cylinder unit 66. The longitudinal displacement of housing 64 carrying the gripper means is provided by an independent motor 68 driving spindle 70 via transmission member 69. Spindle 70 reciprocates the gripper means 62 in the longitudinal direction of the drum through spindle nut 71 and guide bar 72. Preferably, gripper means 60 is provided at an angle of about 15 degrees relative to a vertical extending through the drum axis. The travel path of the gripper means is shown as "X" in FIG. 10 to the drum. As can best be seen in FIG. 7, support 20 is provided with guides 76 along which are sliding the sleeves 77 at the side facing the cone portion 4 of drum 2. An adjustment is possible by a crank handle 78. There are guide rods 79 on which bushings 80 or rolls are mounted in vertical direction to the sleeves. A heddle frame 81 is fixed to guide rods 79 in which a predetermined number of heddle 82 are supported displaceably in height. A shedding between specific groups of yarn sheets may be performed in the usual manner by heddles 82. There is provided a piston-cylinder-unit 83 for displacing the bushings 80 or rolls with the heddle frame 81 along the guide rods 79.

Figure 6:
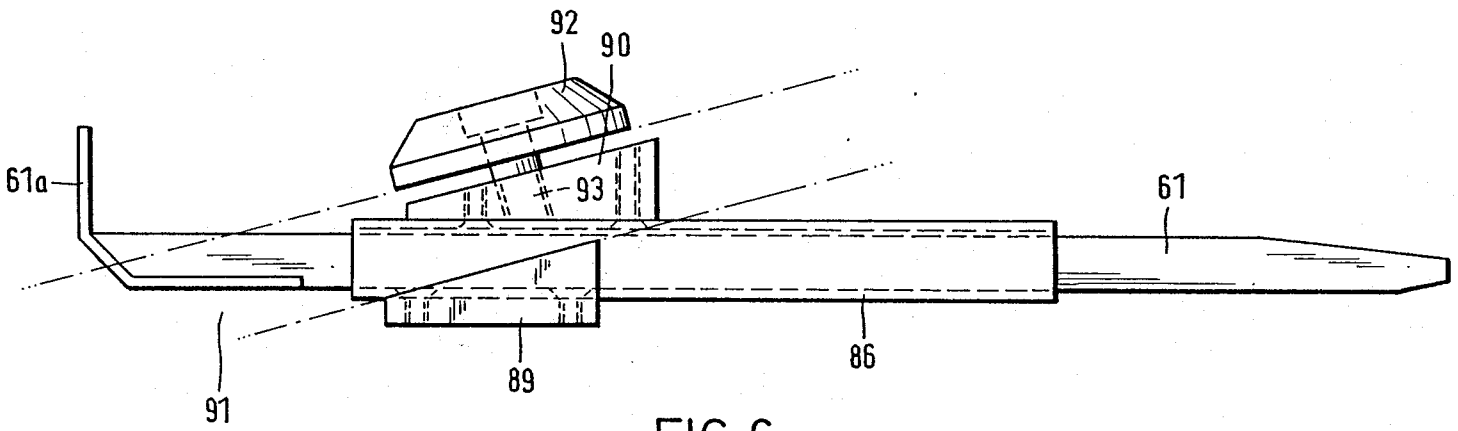
FIG. 6 shows an embodiment of the fixation of a lease rod in the slot of the cone portion of the drum.

As can best be seen in FIG. 6, the front end of the lease rod 61 has an angular portion **61*a* the lease rods are adequately held in slots of the cone portion 4 of drum 2 by means of a sleeve 86. Sleeve 86 is inserted into one of the slots 87, 88 of the cone portion. Sleeve 86 is provided with clamping members 89 which engage under the drum shell 91. Guide member 90 in the groove of the cone portion serves for receiving a clamping screw 93. Clamping member 92, on the other hand, is provided for bracing the total unit. Upon tightening the clamping screw 93, sleeve 86 is braced by means of element 89 in the slot of the cone portion. Preferably, the cone portion 4 of drum 2 is provided with twelve slots 87, 88 for receiving the lease rods. Slots 87 and 88 are mutually offset by 30 degrees. Slots 87 start from the head of the cone portion 4 and end at a predetermined distance from the base thereof. The lower slots 88 begin at the bottom of the cone portion 4** and extend over a restricted length only.

Figure 7:
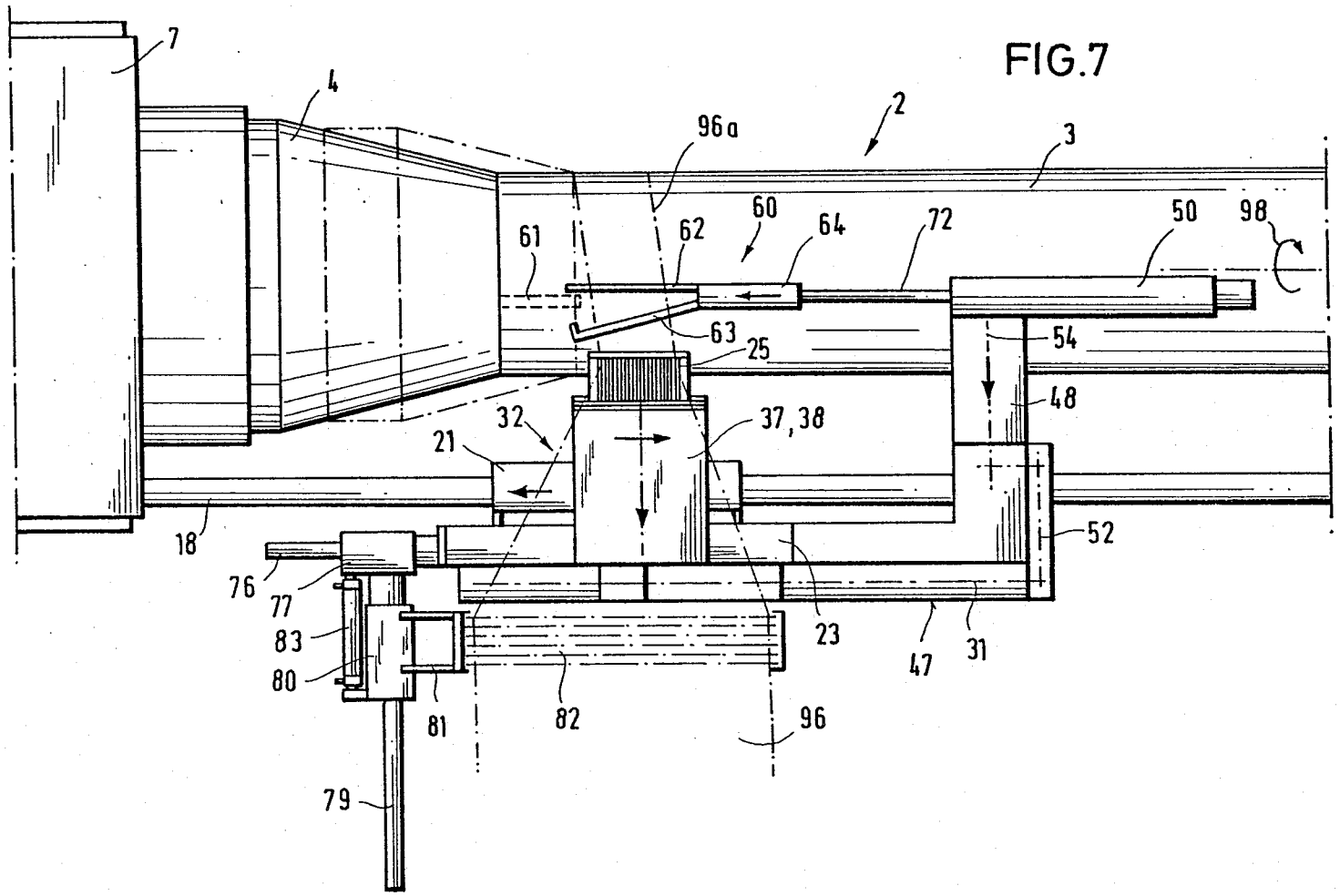
FIGS. 7, 8, and 9 show a plan view of the cone warping machine of the invention to illustrate special positions of the means during the functional sequence.
Figure 8:
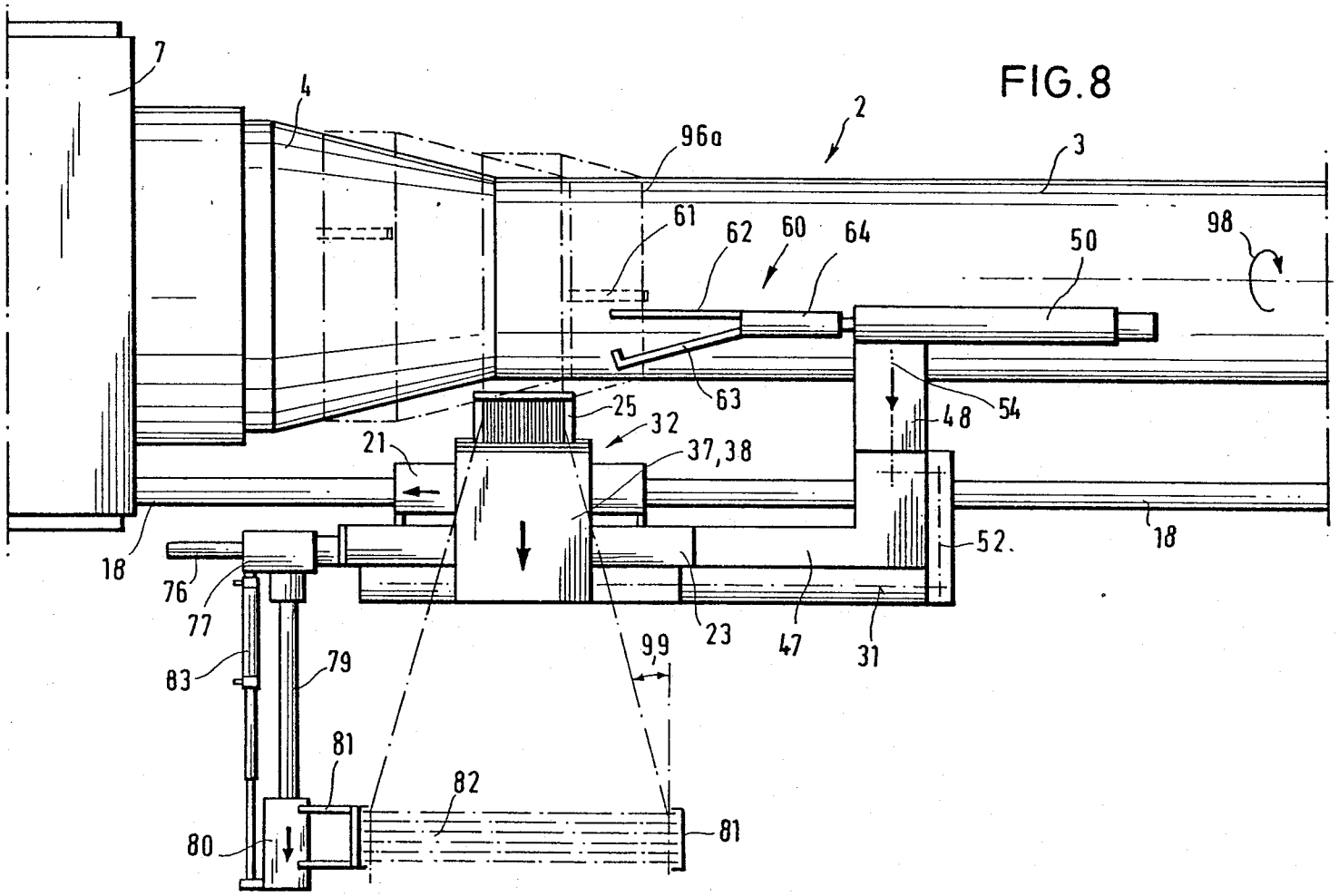
Figure 9:
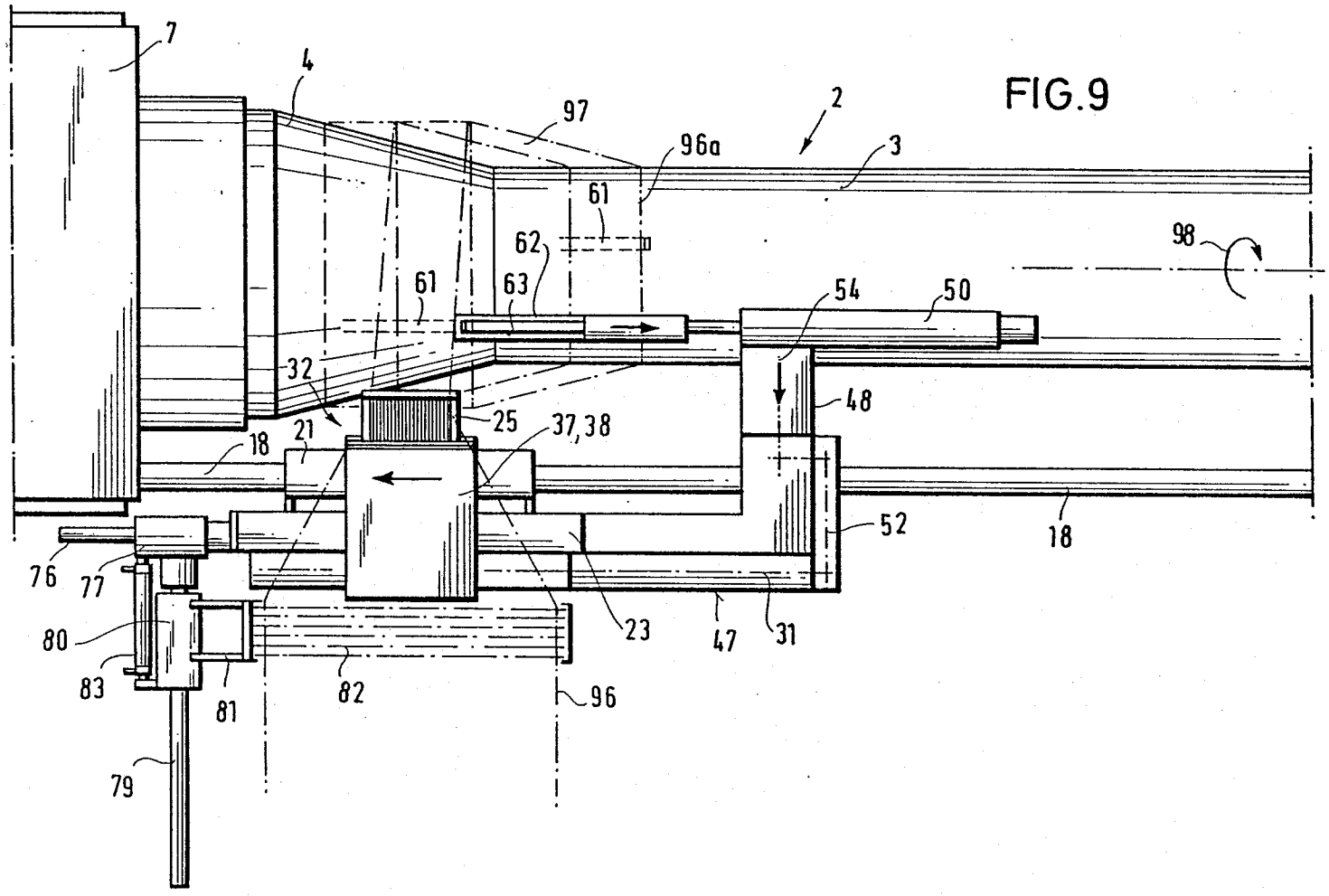

FIGS. 7 to 9 illustrate schematically the functional sequence of the sliding reed, the gripper means, and the heddle frame in relative relationship to each other.

Yarn sheet 96 is threaded through heddles 82 for shedding, through the warping reed 25 acting as a sliding reed, to be wound onto the drum 2. FIG. 7 shows the basic position for winding of the yarn sheet 96 onto the cylindrical portion 3 of the drum at the point of starting. As the yarn sheet is wound onto the drum cylinder, the lease rods are advanced towards the drum end. The sliding reed 25 is also displaced from the center towards the drum end in order to direct the yarn sheet to the lease rods 61 (FIG. 7.). While support 23, heddles 82 and gripper means 60 remain in the basic position, the sliding reed 25 is shifted towards the drum end (FIG. 7). At the same time, the gripper means 60 is moved through the yarn sheet **96*a* opened by shedding towards the cone portion 4 until the gripper fingers 62, 63 may seize the respective lease rod 61 to place it into position (FIG. 8). Subsequently, the gripper means 60 is opened and returns into the withdrawn position. In the meantime, the sliding reed 25 is moved again into the central position (FIG. 8**). The drafted arrows mark the travel movement of the individual unit while the yarn sheet is wound onto the drum.

Upon each advance of the lease rod or of the rods, the drum turns intermittently clockwise as indicated by arrow 98 until the desired number of lease rods is displaced through the sheds of the opened yarn sheet **96*a*. The motion cycle is relatively slow, and the heddle frame 81, 82 approaches support 23 relatively closely. Thereafter, yarn sheet 96*a* is quickly wound. To this end, heddle frame 81 with heddles 82 is moved into the return position (FIG. 8). As a result, an angle 99 formed between an outer limitation of yarn sheet 96 and a course convergent towards warping reed 25 becomes relatively small at a high drawing speed. This moves yarn sheet 96** from the warp creel while the friction of the threads is reduced at the same time.

FIG. 9 shows the displacement of sliding reed 25 upon termination of package 97, i.e. in its upper region. Sliding reed 25 is shifted towards cone portion 4 so that, in the upper region, the opened yarn sheet 96a is placed behind the lease rod drawn by the gripper means 60. Heddles 81, 82 are in the basic position, namely near support 21, 23. When lease rods 61 with the angular portion have been drawn in front of yarn sheet 96, gripper means 60 is opened again. For the subsequent production of a new package, yarn sheet 96a is passed over a short distance again to the circumferential surface of cylindrical drum portion 3. The support with the gripper means and the warping reed 25 are shifted correspondingly. Another yarn sheet may be wound now to form an additional package beside package 97, with the position of the system shown in FIG. 7.

Figure 10:
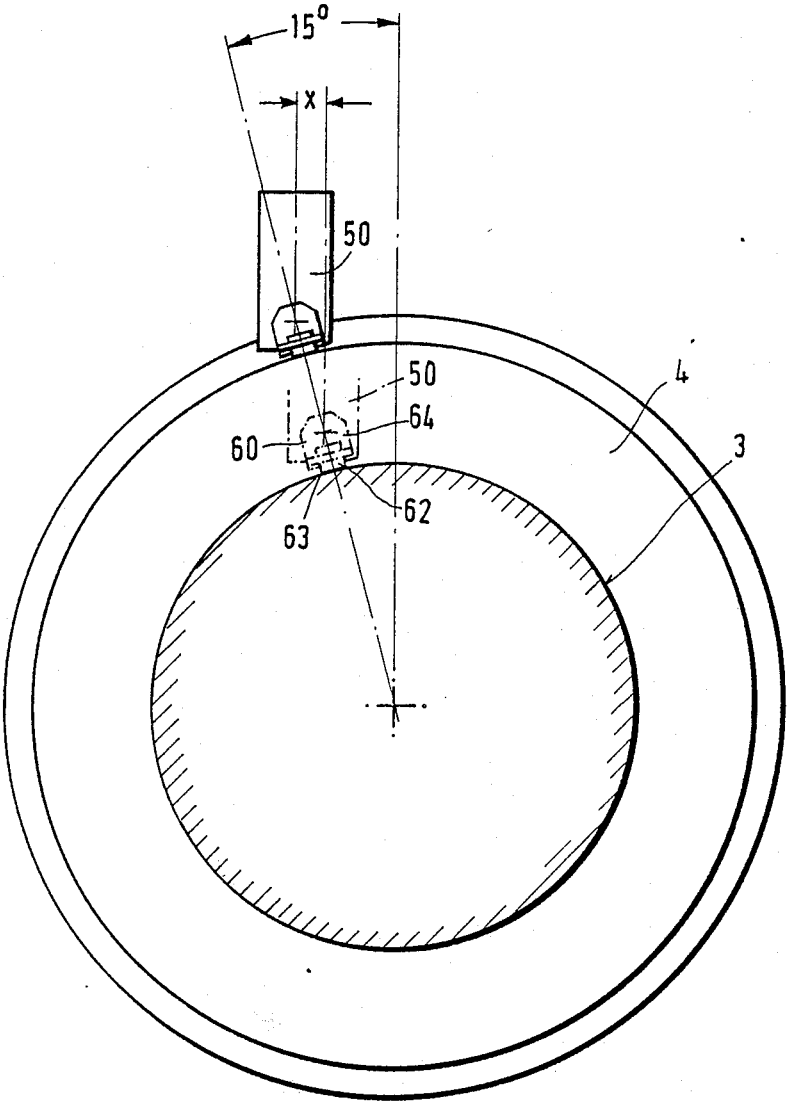
FIG. 10 is a front view of the drum illustrating the travel path of the gripper means from the lower position to the upper position during the production of a thread package.

The drives derived from shaft 31, i.e. height adjustment of support 20, displacement of reed 25, and displacement of tong movements 49 transversely to the drum, are in a predetermined fixed relationship responsive to the position of the support at the beginning of the winding (at the bottom of the cylindrical drum 3), and at the end of winding 97 (at the top of the cone portion 4) (FIG. 10). For shifting reed 25 and gripper means 64 along the drum and for opening and closing the legs of tongs 60, corresponding separate drives are provided. All of the drives may be controlled in time by an electronic switch mechanism (not shown) in a conventional programmed manner. The warping machine may be operated fully automatically with a corresponding program.

While a preferred embodiment of the invention has been described using specific terms, such description is for illustrative purposes only, and it is to be understood that changes and variations may be made without departing from the spirit or scope of the following claims.

What is claimed is:

1. Apparatus for producing pattern warps on a cone warping machine of the type comprising a drum having a cone portion, a support means for receiving a heddle frame, a warping reed, lease rods disposed in slots of the cone portion of the drum, displacement means for displacing the lease rods along the drum axis, driving means for rotating the drum and for moving said support means along the drum axis, and a control means for controlling said drive means to provide for the intermittent rotation of the drum and for the displacement of the support means in a predetermined relation; characterized in that said displacement means for displacing said lease rods includes a tong-type gripper having a pair of tong legs for engaging said lease rod.

2. Apparatus of claim including means for moving said warping reed vertically with respect to the longitudinal axis of said drum and for moving said warping reed from a central position to opposing directions with respect to said support means.

3. Apparatus of claim 1 including means for adjusting said heddle frame together with heddles vertically in height

4. Apparatus of claim 3 wherein said heddle frame is displaceable transversely to said drum by means of a piston-cylinder-unit.

5. Apparatus of claim 1 wherein said gripper tong legs are arranged in horizontal plane of which a first stationary leg is stationary and a second movable leg is hook-shaped and disposed to be movable in the horizontal plane.

6. Apparatus of claim 5 wherein said movable tong leg is driven by a piston-cylinder-unit.

7. Apparatus of claim 1 wherein said tong-type gripper means is displaceable along said drum by means of an adjusting unit.

8. Apparatus of claim 2 wherein said warping reed is disposed on a cross slide which is carried by said support.

9. Apparatus of claim 1 characterized in that the heddle frame is adjustably carried along a guide extending transversely to said drum and said heddle frame is moved by an air cylinder mounted at said support.

10. Apparatus of claim 1 including a sleeve for receiving and mounting said lease rods, said sleeve firmly clamping said lease rods in the slot provided in said cone portion of said drum by means of clamping members.

11. Apparatus of claim 10 wherein said cone portion of said drum is provided with twelve slots for receiving said lease rods, and said slots are offset from each other by 60 degrees from the bottom to the top of the cone portion, and said slots are of a restricted length.

12. Apparatus of claim 11 wherein said support means includes a first carriage displaceable along the axis of said drum and a second carriage displaceable vertically in height with respect to said first carriage, and a driving means carried by said second carriage for transmitting a sliding movement to said warping reed transversely to said drum, said driving means further transmitting a movement to adjust the height of said second carriage and to displace said tong-type gripper in a transverse direction to the drum.

13. Apparatus of claim 12 wherein said driving means includes a driving motor carried by said support means which imparts said drive for the moving of said warping reed transversely to the drum for the height adjustment of said second carriage, and for the displacement of said tong gripper transversely to said drum.

14. Apparatus of claim 13 including an independent drive provided for the adjustment of said reed in a direction along an axis of said drum.

15. Apparatus of claim 14 including an independent drive is provided for the adjustment of the tong gripper along the axis of said drum.

16. In a cone warping machine, the combination of a drum having a cone portion, support means carried for movement along the axis of said drum; a heddle frame carried by said support means; a warping reed carried by said support means; lease rods carried on said cone portion of said drum; displacement means for displacing said lease rods along the axis of said drum; first drive means for rotating the drum and moving said support means along said drum axis is a predetermined relationship: a first carriage carried by said support means for movement along the axis of said drum; a second carriage carried by said first carriage for movement in a vertical height direction relative to said drum; said displacement means for displacing said lease rods being carried by said second carriage; and said heddle frame being carried by said first carriage.

17. Apparatus of claim 16 wherein said displacement means includes a tong gripper having a first tong leg and a second tong leg for engaging said lease rod to displace said lease rod.

18. Apparatus of claim 17 wherein said first tong leg is stationary and said second tong leg is movable.

19. Apparatus of claim 16 including a second drive means carried by said support means for displacing said warping reed transverse to said drum, adjusting the height of said second carriage, and for displacing said tong gripper in a transverse direction to the drum.

20. Apparatus of claim 19 including an independent third drive means for adjusting the position of said warping reed in a direction along an axis of said drum.

21. Apparatus of claim 20 including an independent fourth drive means for adjusting the position of said tong gripper along said axis of said drum.

* * * * *